US005097788A

United States Patent [19]

Castel

[11] Patent Number: 5,097,788

[45] Date of Patent: Mar. 24, 1992

[54] METHOD AND DEVICE FOR FISHING UP AN IMMERSED BODY

[75] Inventor: Yvon Castel, Croissy sur Seine, France

[73] Assignee: Institut Francais du Petrole, France

[21] Appl. No.: 515,434

[22] Filed: Apr. 27, 1990

[30] Foreign Application Priority Data

Apr. 27, 1989 [FR] France ..... 89 05781

[51] Int. Cl.[5] ..... B63B 21/50

[52] U.S. Cl. ..... 114/293; 441/4

[58] Field of Search ..... 114/293, 297, 299, 210, 114/51; 441/7, 21, 23, 24–27

[56] References Cited

U.S. PATENT DOCUMENTS 4,033,277 7/1977 Schaper ..... 114/293
4,262,379 4/1981 Jankiewicz ..... 441/23
4,535,430 8/1985 Cochrane, Jr. et al. ..... 441/23

*Primary Examiner*—Jesus D. Sotelo
*Attorney, Agent, or Firm*—Antonelli, Terry Stout & Kraus

[57] ABSTRACT

A method and device for fishing up an immersed body from a position spaced from and disposed above the immersed body. A fishing member is moored to the body, with the member including a support integral with the body and a releasable portion. The support and the releasable portion are initially assembled together. The releasable portion is released, leading to the separation of the releasable portion and the support. Upon the releasable portion reaching the position, at the level of the position lift connecting members are moored to the fishing member, with the lift connecting members being attached to the body and to the releasable portion. This fishing member is actuated so as to place the body in a vicinity of the fishing member.

11 Claims, 10 Drawing Sheets

METHOD AND DEVICE FOR FISHING UP AN IMMERSED BODY

BACKGROUND OF THE INVENTION

The present invention relates to a method and device for fishing up an immersed body remotely from a position disposed substantially above this body.

More particularly, the invention applies to the recovery of an anchorage line, such as a chain for mooring sea vessels, such as oil platforms. The invention may in particular be applied to the field of oil effluent production, in Polar seas in regions subjected to the passage of icebergs, and in regions subjected to very severe weather conditions (wind of 150 km/hour, waves reaching 30 m); when it is a question of rapidly removing a surface vessel, such as a processing platform, from a critical zone. This vessel may moreover be coupled to a bottom base by flexible lines, as is described in the patent applications FR 2 600 710, FR 2 600 711 and FR 2 600 712.

Removal of the vessel takes place by leaving in position only the sea bottom installations and the anchorage lines for the vessel.

It is known, for locating or lifting a deadman disposed on the sea bed, to use a surface buoy connected by a link to this deadman and effect an upward pull on the link for lifting the deadman. This technique cannot be applied to the lifting of coil platform anchorage chains, for the existence of buoys and links in the vicinity of the anchorage chains during storms, when the platform is anchored to the sea bed (at least approximately 100 m below the level of the surface of the sea) risks tangling the links and chains together or fatiguing the elements subjected to the high stresses.

In order to overcome these drawbacks in particular, the invention provides a method and device which can be used for lifting deadmen and, in particular, anchorage chains for oil platforms disposed in subsea waters having difficult access.

SUMMARY OF THE INVENTION

The method according to the invention for fishing up an immersed body from a position spaced and disposed above the body is characterized in that it comprises the steps of mooring a fishing member to an immersed body, with the fishing member comprising a support integral with the body and a releasable portion, and with the support and the releasable portion being initially assembled together. The releasable portion is released leading to a separation of the releasable portion and the support, and, upon the releasable portion reaching the position, at the level of the position, lifting connecting means are moored to the fishing member, with the lifting connecting means being attached to the body and to the releasable portion. Fishing means are then actuated so as to place the body in a vicinity of the fishing member.

In a particular embodiment of the present invention, the lifting connecting means are positioned once the releasable portion has been freed, with the releasable portion being connected to the support by temporary connecting means comprising a temporary connecting element having first and second strands connected together at one of their ends and cooperating with return means fast with the support.

In one embodiment, where the body to be fished up is an anchorage line for a floating vessel substantially above the body, in the vicinity of the position, the anchorage line is moored to the vessel.

In one embodiment of the invention, when the releasable portion is separated from the support and connected to the support by the connecting means, for assembling the releasable portion with the support, a retractable tool is disposed about the releasable portion for reeling in the connecting means in the releasable portion so as to assemble the support and the releasable portion together, and, after assembling the support with the releasable portion, the tool is retracted.

In another embodiment, when the body to be fished up is an anchorage line for a floating vessel substantially above the body and in a vicinity of the position, with the line comprising a free end adapted to be moored to the vessel, the fishing member is disposed at a distance from the free end which is adapted so that, when the line is moored to the vessel and the releasable portion assembled with the support, the fishing member is not appreciably subjected to the action of physical disturbances existing in a vicinity of the vessel and the lifting connecting means are disposed between the fishing member and the mooring line at a point disposed on the anchorage line between the line end and the fishing member and disposed in the vicinity of the end.

In another embodiment, a device is disposed on the lifting connecting means for spacing the lifting connecting means apart from the anchorage line.

The present invention also relates to a device for remotely fishing up a body immersed in water from a position situated substantially vertically above the body, with the device comprising a fishing member with a support fast with the body and a floating releasable portion, and with the support and the releasable portion being coupled together by connecting means.

The device according to the present invention is characterized in that the releasable portion comprises means for storing the connection means, with the means for storing being adapted for unwinding the connecting means when the releasable portion is separated from the support and rises to the surface of the water.

According to the invention, the connecting means are temporary connecting means in the form of a loop having a first strand and a second strand connected together at the level of return means fast wit the support, with the return means cooperating with the connecting means, and with the return means and the temporary connecting means being adapted for replacing the temporary connecting means by connecting means for lifting the body.

The device of the invention may comprise a retractable rewinding tool adapted for cooperating with the storage means for rewinding the connecting means in the storage means.

The device of the invention may also comprise means for remotely causing separation of the support and the releasable portion.

The device of the invention, applied to the case in which the body comprises the end of an anchorage line may be characterized in that it comprises lifting connecting means between the releasable portion of the fishing member and the fishing line at a point situated on the anchorage line, between the fishing member and the end of the anchorage line.

BRIEF DESCRIPTION OF THE DRAWINGS

The invention will be well understood and its advantages will be clear from the following description when taken is connection with the accompanying drawings, wherein.

DESCRIPTION OF PREFERRED EMBODIMENTS

Figure 1:
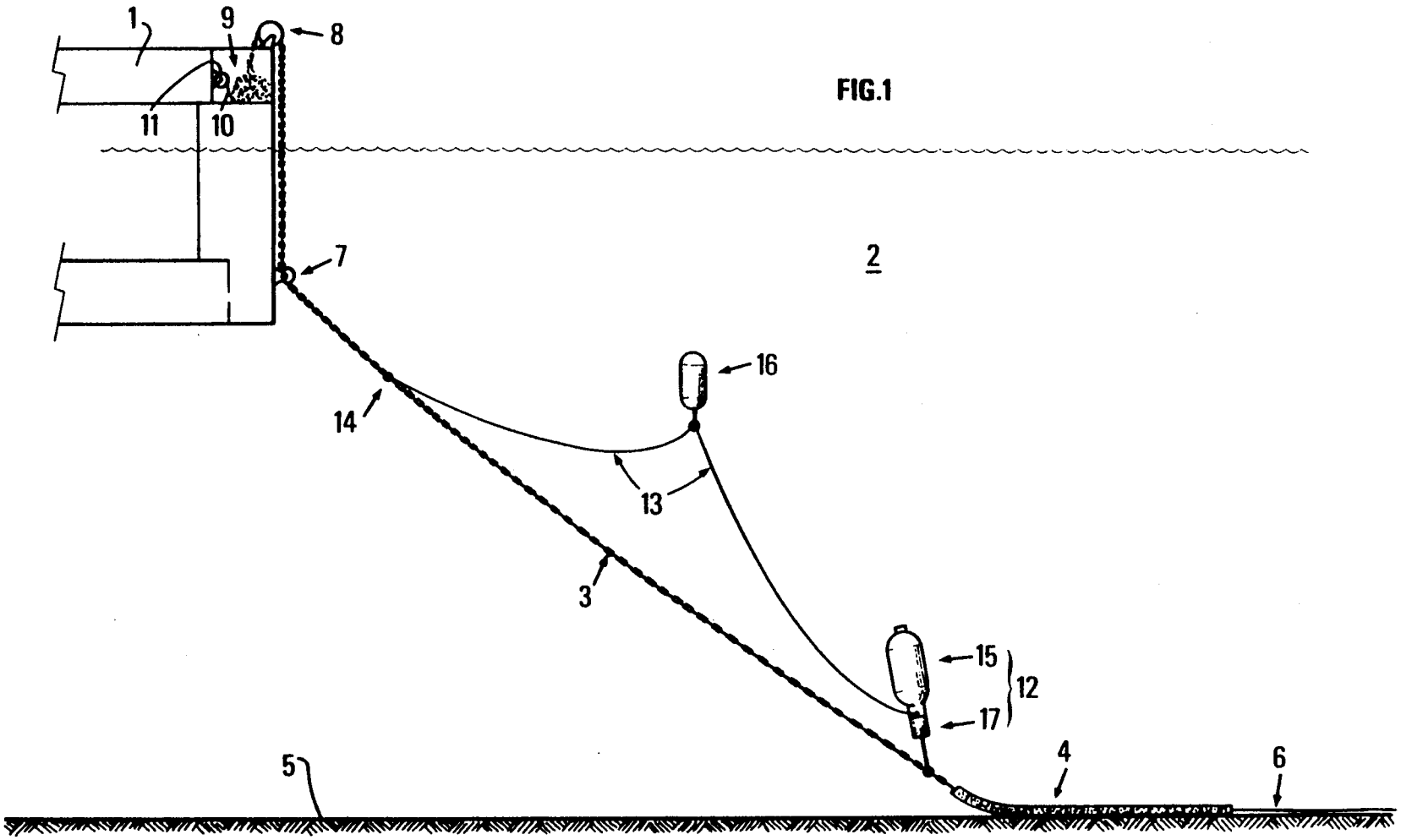
FIG. 1 is a schematic view of an arrangement of the device according to the invention prior to a release of an anchorage chain.

In FIG. 1, the vessel 1, which is an oil platform floating on the surface of the sea 2, is moored to several anchorage line ends, such as a releasable end of an anchorage line 3. The anchorage line 3 comprises a chain weighted by a weight 4 on a portion of the anchorage line 3 resting on the sea bed 5. The anchorage line 3 comprises a strand 6 moored to an anchor or a stake driven into the sea bed 5.

The end of anchorage line 3 is fixed to vessel 1 by a set of elements comprising a return pulley 7 and a chain winch 8.

The return pulley 7 is disposed towards the bottom of the vessel so that the action exerted from this vessel on the anchorage line is as horizontal as possible so as to avoid disengagement of the anchor and also to allow access to the platform by supply ships and others. The chain winch 8 is located above the level of the sea and provides tensioning and blocking of an anchorage line. The non tensioned end of the anchorage line 3 is stored in a well 9 in vessel 1 and this end is fixed by a clinch to a take-up cable 10 which may be tensioned by winch 11. The device of the invention applied to anchorage lines comprises a fishing member 12, lifting connecting means 13 fixed by an attachment 14 to a releasable portion 15 of the fishing member 12 and to the anchorage line 3 on the non tensioned end side. The lifting connecting means 13 are spaced apart from the anchorage line 3 by a buoy 16 which prevents the cable of the mechanical connection 13 from tangling with the anchorage line 3, under the action of the swell. The position of this buoy 16 is judiciously defined so as to limit the action of the swell on buoy 16, while spacing the lifting connecting means 13 away from the anchorage line 3. The length of the lifting connecting means 13 is adapted so that the releasable portion 15 of the fishing member reaches the surface of the sea, and its strength is sufficient for lifting the anchorage line 3 until attachment 14 comes out of the water.

The fishing member 12 comprises the releasable portion 15 and a support 17 fixed to the anchorage line 3.

When it is desired to raise the anchor of vessel 1, the chain winch 8 and the winch 11 of the take-up cable are released until the anchorage line 3 drops to the bottom of water 5. This operation is repeated as many times as there are anchorage lines for the vessel.

Figure 2:
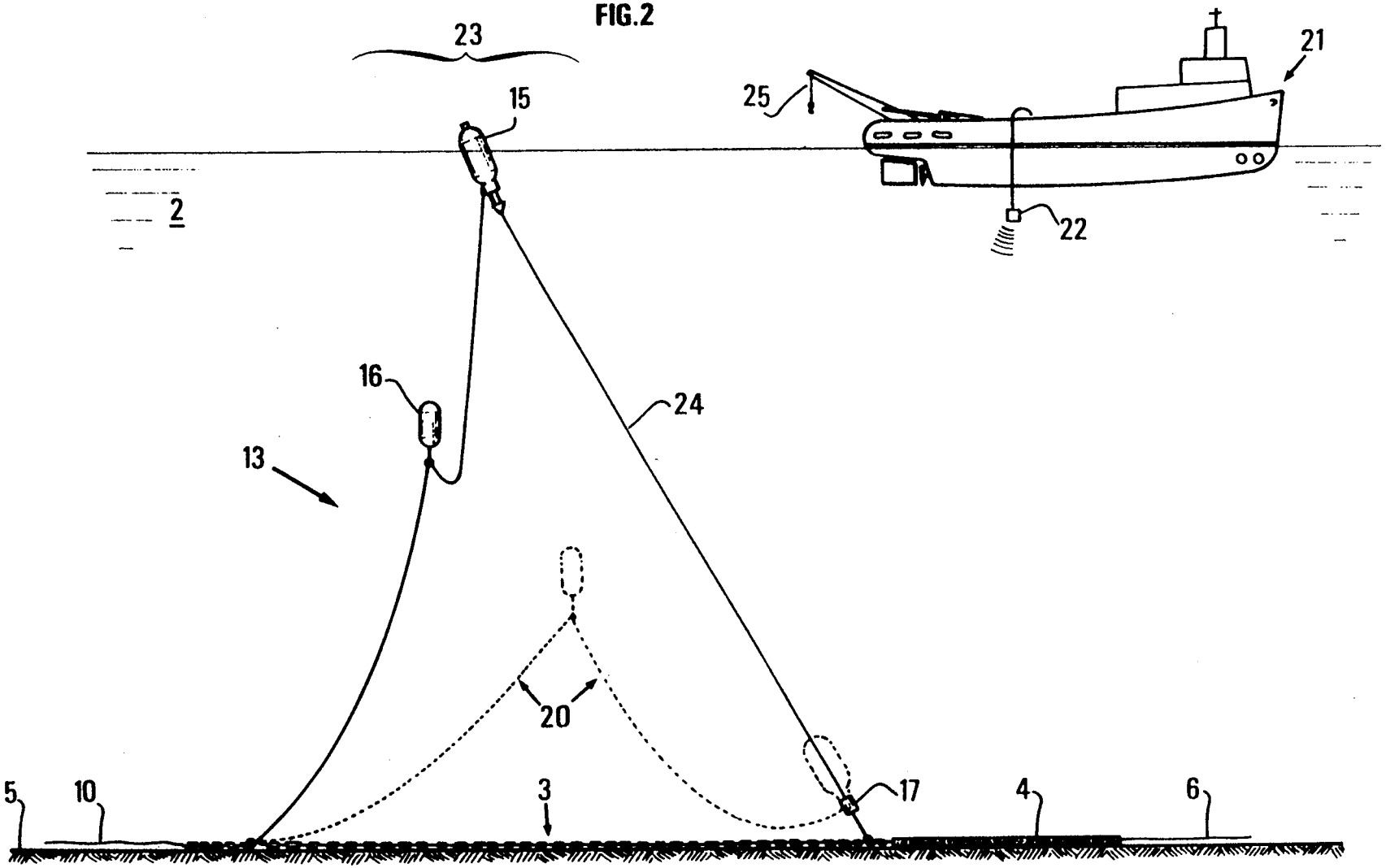
FIG. 2 is a schematic view of the device of the invention just before and after release of a portion of the lifting member.

In FIG. 2, the anchorage line 3 rests at the bottom of water 5. The dotted portion 20 of FIG. 2 shows the means 13 for lifting and connecting buoy 16 and the releasable portion 15 in the position which they occupy just after the anchorage line 3 has dropped to the sea bed 5.

When it is desired to recover the end of anchorage line 3, for example, for anchoring the vessel again, release of portion 15 is remotely triggered. Such triggering may be carried out by sending, from a ship 21, sound or ultrasonic signals generated by a transmitter 22 disposed, for example, under the hull of ship 21. The releasable portion 15 is equipped with a receiver sensitive to the acoustic waves emitted by transmitter 22 and capable of triggering separation of support 17 and the releasable portion 15.

Release of portion 15 allows the latter to reach a position 23 at the surface of the water and causes unwinding of the connecting means 24, with these connecting means extending between support 17 and the releasable portion 15.

When the releasable portion 15 has reached the surface of the water, the ship 21 is brought close to portion 15 and the releasable portion 15 is moored to ship 21 by the mooring line 25. The releasable portion 15 is then raised, and then buoy 16 by means of the mooring line 25, the crane and the winches of the ship.

Figure 3:
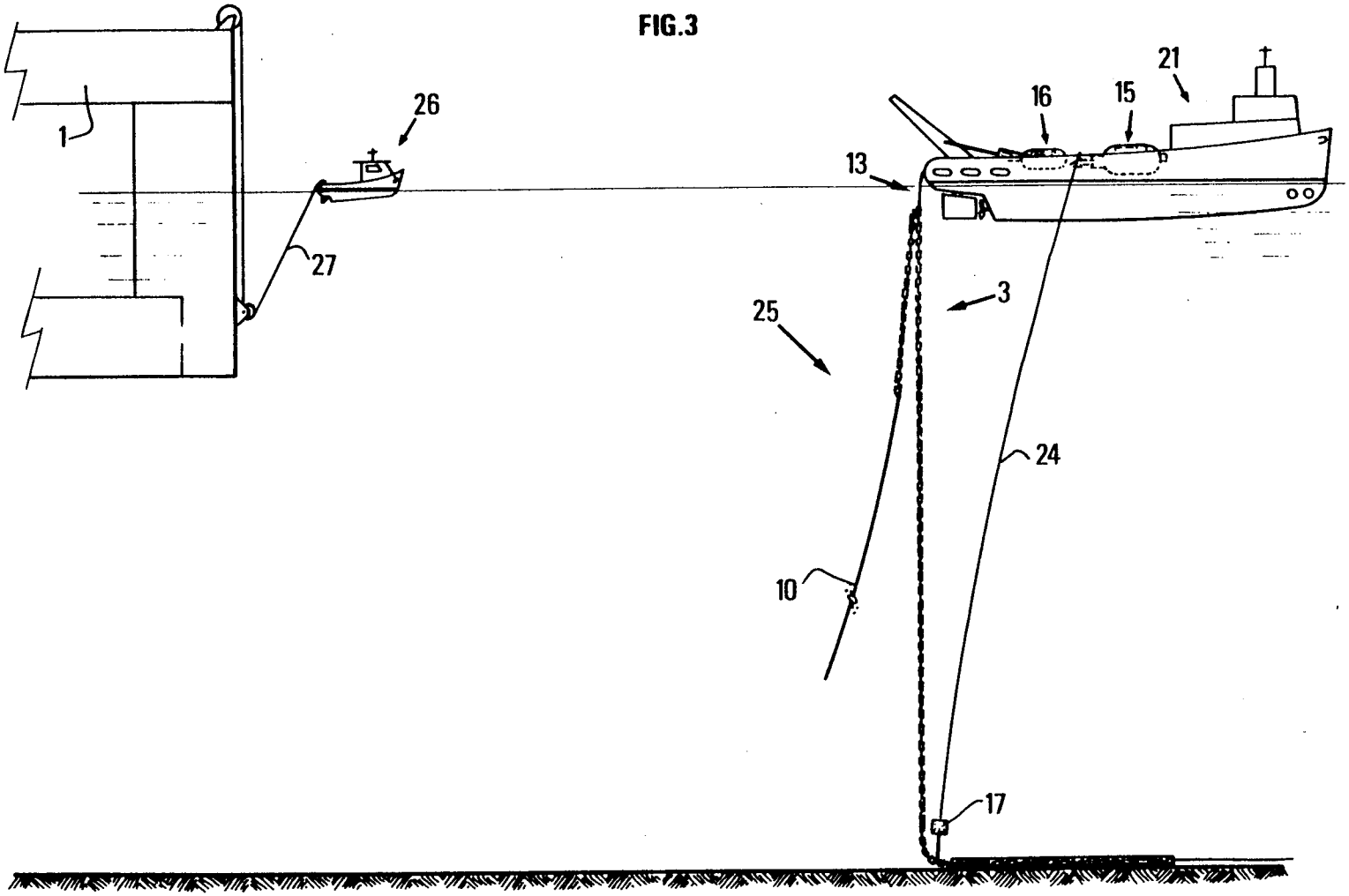
FIG. 3 is a schematic view of a step for raising the anchorage chain.

FIG. 3 shows a step for raising the anchorage line 3. The lifting connecting means 13, the buoy 16, the releasable portion 15 of the fishing member 12 have already been hauled on to the deck of the ship 21.

The free end 25 of anchorage line 3 connected to the take-up cable 10 is raised so that the take-up cable 10 can be readily accessible from the surface of the water.

Simultaneously with raising line 3 and cable 10, from vessel 1, for example, using a boat 26, a branch cable 27 is brought for connection to the end of the take-up cable 10, with the other end of the branch cable 27 being wound on winch 11.

Figure 4:
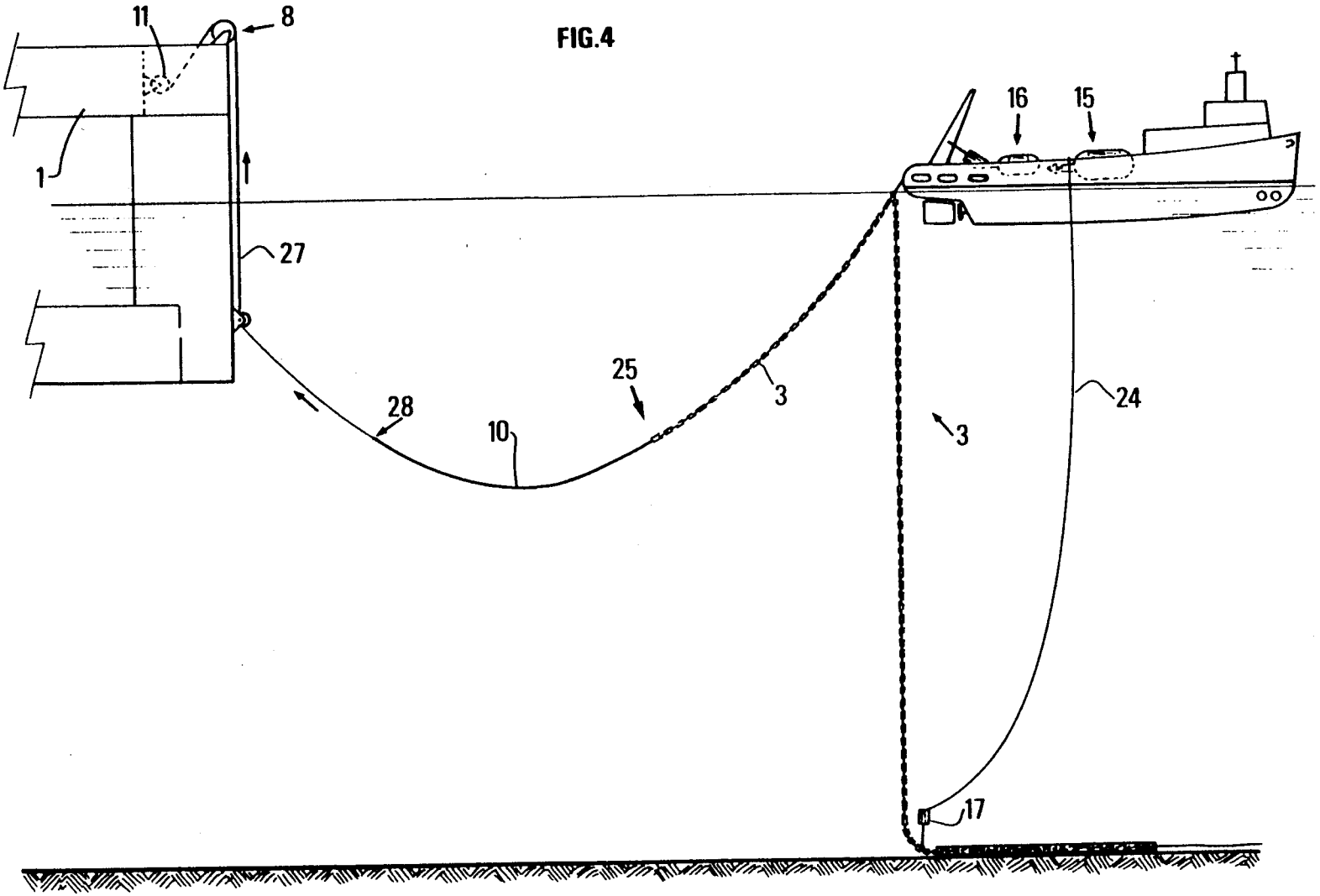
FIG. 4 is a schematic view of a mooring of the anchorage chain to a vessel, such as an oil production platform.
Figure 5:
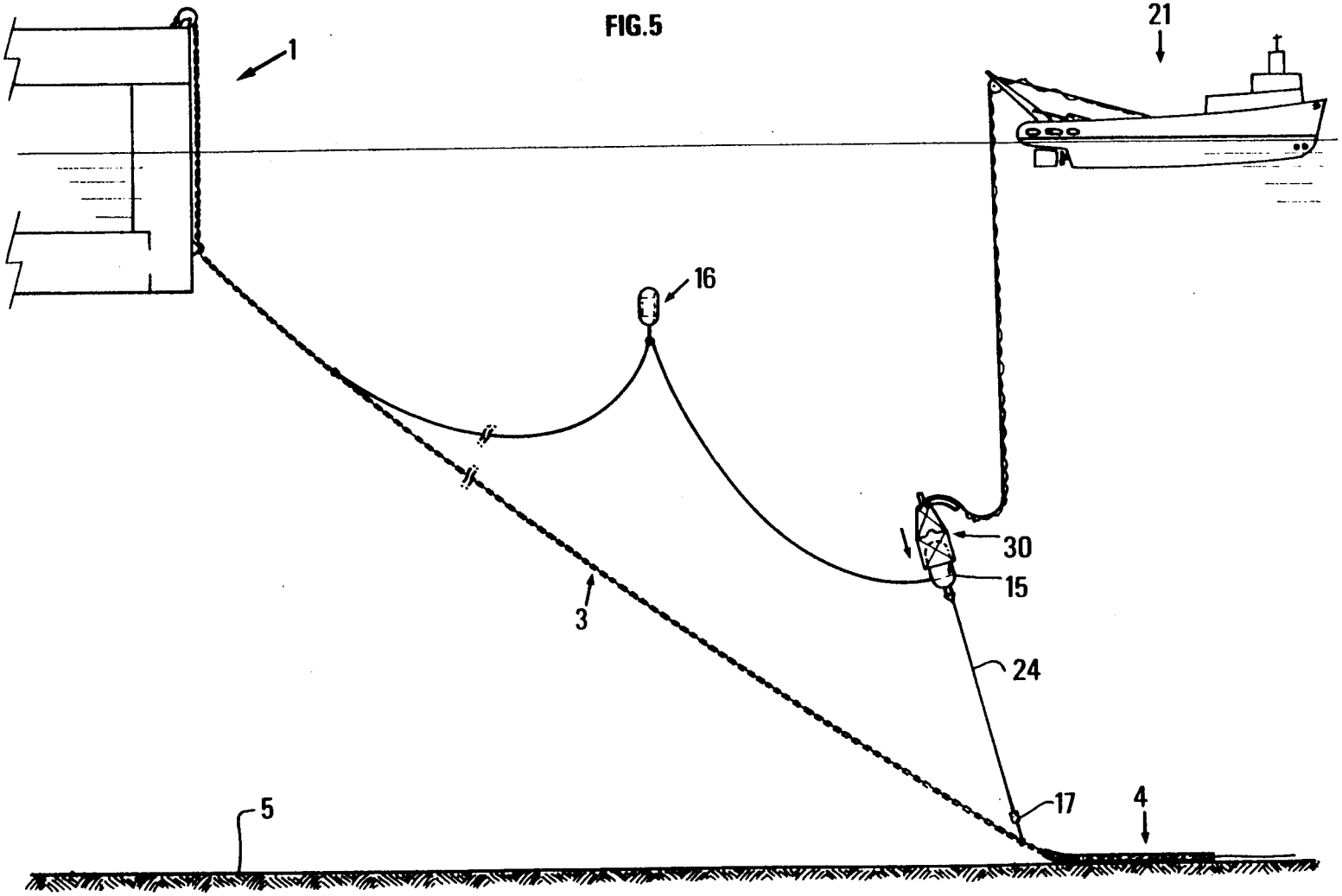
FIG. 5 is a schematic view of the invention during a step of re-assembling the fishing member.

FIG. 4 shows the step for mooring the anchorage line or chain to vessel 1 which may be a platform. The take-up 10 and branch 27 cables are connected together by a temporary resistant junction 28. Cable winch 11 is actuated so as to bring end 25 of line 3 to the level of the chain winch 8. Once chain 3 is engaged on the chain winch 8, cable 10 is unwound again from winch 11 so as to suppress connection 28 with the branch cable 27. Cable 10 is again wound on winch 11 which will serve as a brake for the anchorage line 3 at the end of release of the chain. During this operation, ship 21 accompanies the movement of line 3 and progressively places the lifting connecting means 13 in the water until the configuration illustrated in FIG. 5 is substantially reached. FIG. 5 shows schematically the hauling of the releasable portion 15 of the fishing member, along the connecting means 24, by means of a retractable rewinding tool 30 connected to ship 21.

Such hauling is carried out until the releasable portion 15 is assembled with support 17. Once such hauling is finished, the retractable tool 30 is hoisted on to ship 21, and may be used again for positioning another anchorage line. The configuration obtained after hauling portion 15 towards support 17 is identical to that shown in FIG. 1.

When maintenance on the releasable portion 15 of the fishing member is required, when vessel 1 is moored to anchorage line 3, portion 15 may be releasable by means of an acoustic signal transmitter 22 used in the step shown in FIG. 3. Thus, the releasable portion 15 reaches the surface of the water. In this position, the portion is hoisted on board a ship 21 and can be checked or replaced by a temporary buoy or another releasable portion previously serviced. Hoisting of the releasable portion 15 takes place with the retractable tool 30 in the same way as in the step shown in FIG. 5.

Figure 6:
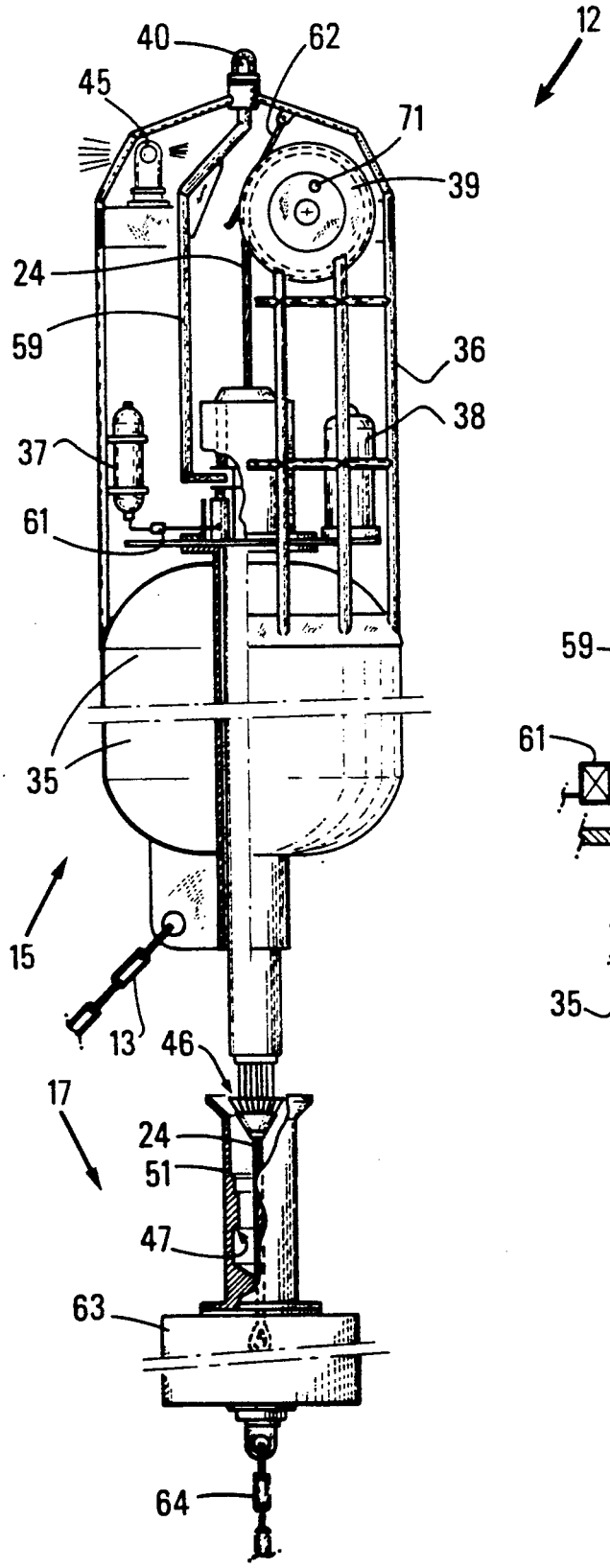
FIG. 6 is a schematic view of a first embodiment of the lifting member of the present invention.

FIG. 6 shows a first embodiment of the fishing member 12 which comprises a lower portion 17 or support and an upper portion floating in the water or releasable portion 15.

The releasable portion 15 is attached to the lifting connecting means 13 of the end of the anchorage line, as shown in FIGS. 1 to 5.

The releasable portion 15 comprises a case 35 filled with syntactic foam, providing sufficient buoyancy of the releasable portion 15 so as to bring this portion to the surface of the water. This case 35 has mounted thereover a structure 36 forming a protective frame and housing a hydraulic accumulator 37 adapted for freeing the releasable portion under the control of the electronic case 38 sensitive to said acoustic signals.

Structure 36 further comprises a winder 39 for the connecting means 24 between support 17 and the releasable portion 15. The upper portion of structure 36 comprises a ring 40 connected to a linkage which makes it possible to free the releasable portion 15 from the fishing member when an upward vertical pull is exerted on ring 40.

The upper portion of structure 36 further comprises a light beacon 45 which emits light flashes at the surface so as to facilitate location of the upper portion 15 of the fishing member 12 once this portion has been released.

Figure 6A:
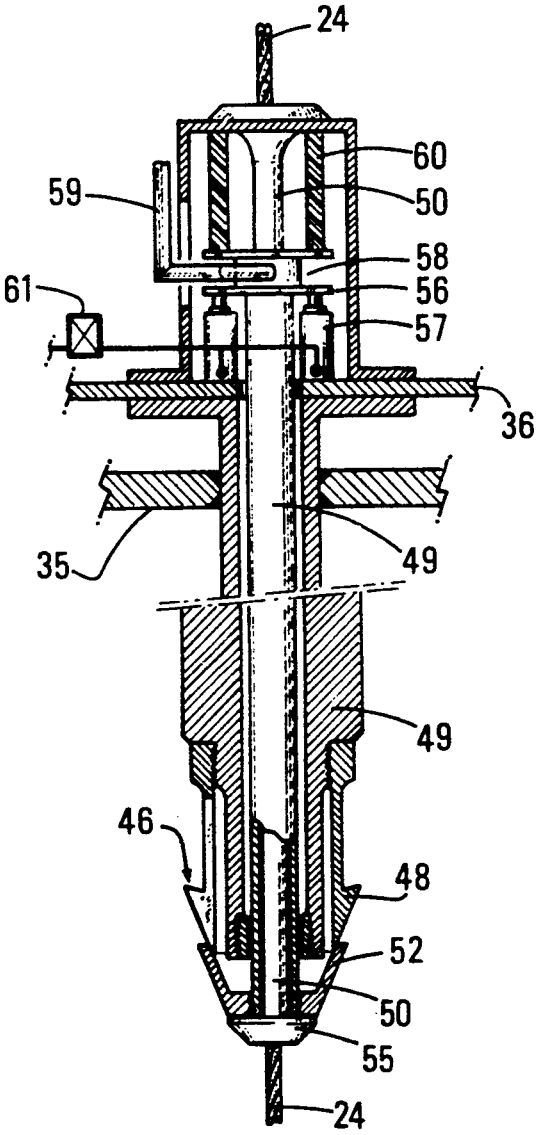
FIG. 6A is a cross-sectional detail view of the mechanism for fastening the releasable portion to the support.

The assembly of releasable portion 15 with support 17 takes place by retractable annular claws 46 integral with said releasable portion 15 which cooperate with the internal shoulder 47 of a tube 51 fixed to support 17 in which claws 46 engage. In FIG. 6A, which shows in detail the mechanism for fastening the releasable portion 15 to support 17, it can be seen that these claws 46 are retracted by means of the cone 52 whose inner surface cooperates with the oblique surface 48 associated with claws 46.

To this end, cone 52 is caused to move in translation by a slide 49 inside which is located a stop tube 50 and the connecting means 24. The stop tube 50 emerges at the top of cone 52 and ends in an overcone 55 adapted for limiting the introduction of claws 46 into tube 51.

The stop tube 50, slide 49, the connecting means 24 pass through tank 35 and end in structure 36. Slide 49 comprises a shoulder 56 which cooperates with the thrust jack 57 for releasing portion 15 and comprises a groove 58 adapted to cooperate with said linkage 59. The upper end of slide 49 cooperates with resilient means 60 fixed to structure 36 so that triggering, by a ring 40, takes place under the action of a given force.

Jack 57 is supplied by the hydraulic accumulator 37 and the control effected by cell 61 connected to the electronic case 38.

Winder 39, which permits storage of the connecting means 24, is braked in rotation by plate 62 which exerts an action of the connecting means 24, through a return spring, so as to provide correct winding and unwinding of the connecting means on winder 39.

The stop tube 50 is fixed at its upper part to structure 36 and has passing therethrough the connecting means 24 which are blocked at the lower part of tube 51.

Support 17 comprises a float 63 disposed between the tube 51 and a chain 64 for mooring support 17 to the anchorage line 3 not shown in FIG. 6.

For fishing up the end of anchorage line 3 of a drilling or production platform, float 63 has a volume of 0.5 $m^3$ and tank 35 has a volume of 10 $m^3$, in agreement with the characteristics (length, weight per unit of length, immersion) of line 3 and so of the anchorage chain 3.

Figure 7:
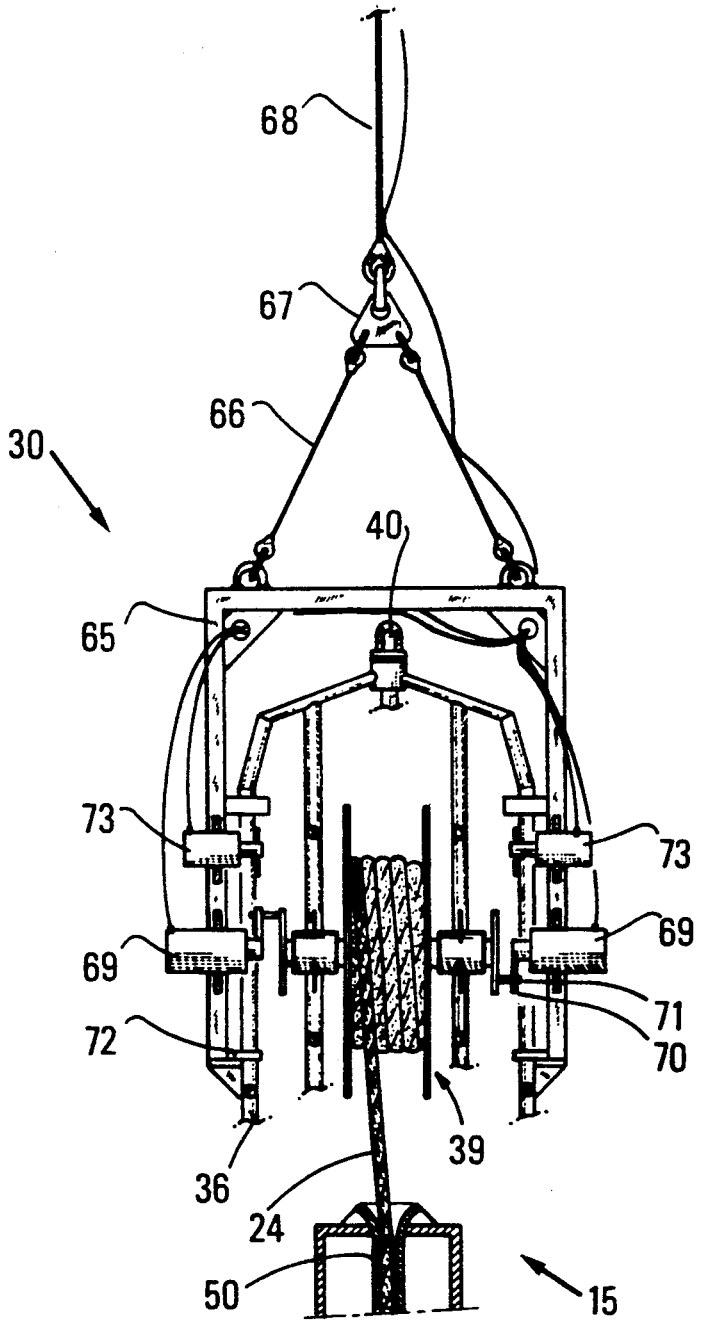
FIG. 7 is a schematic view of a tool for rewinding the fishing member.

FIG. 7 shows a retractable rewinding tool 30 disposed on the upper part of the releasable portion 15. This tool 30 comprises a stand 65 supported by two cables 66 connected by their upper end to a plate 67, itself supported by a cable 68 which extends from ship 21, as shown in FIG. 5.

On stand 65 are disposed two hydraulic geared reduction units 69 each of whose drive shafts comprises a finger 70 adapted each to cooperate with a stud 71 fixed by a plate to the shaft of winder 39, for driving the latter 39. Stand 65 is equipped with fingers 72 which take up the torque of the geared unit 69 which bear on structure 36 of the releasable portion 15 of the fishing member. Stand 65 is locked on structure 36 by means of the two jacks 73.

Figure 8:
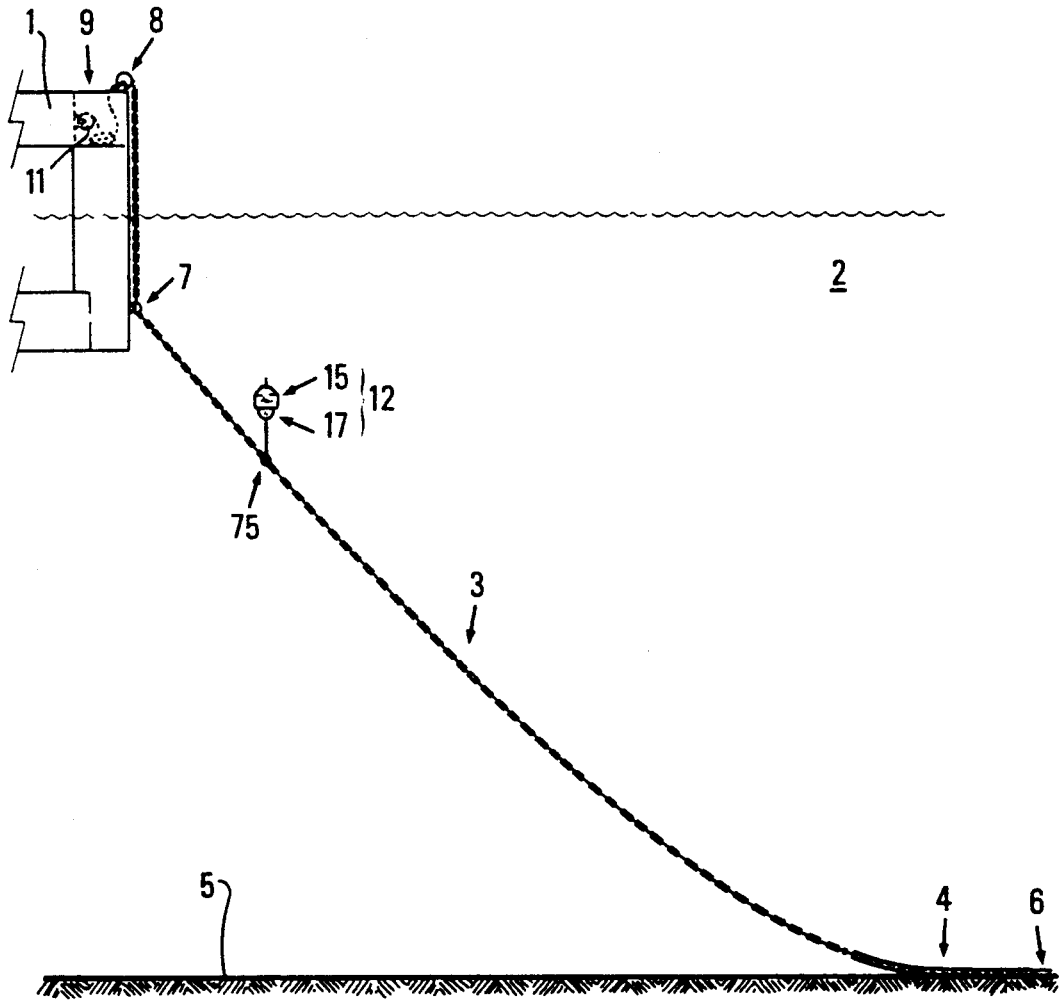
FIG. 8 is a schematic view of another embodiment of a fishing device constructed in accordance with the present invention.

FIG. 8 shows an arrangement of a variant of the device illustrated in FIG. 1. The different elements of this FIG. 8 identical to those of FIG. 1 are referenced in the same way.

FIG. 8 is distinguished from FIG. 1 in that the fishing member 12 is fixed to the end of the anchorage line 3 at a point 75 situated in the immediate vicinity of vessel 1, whereas in the preceding embodiment of the device illustrated in FIG. 1, the fishing member 12 is fixed close to the bottom of the sea.

The simpler arrangement of the device shown in FIG. 8 has however the drawback that the fishing member 12 is greatly subjected to the action of the swell when it exists. When it is desired to free vessel 1 from its anchorage, the anchorage line(s) 3 and their take-up cable 10 are dropped to the bottom of the water.

Figure 9:
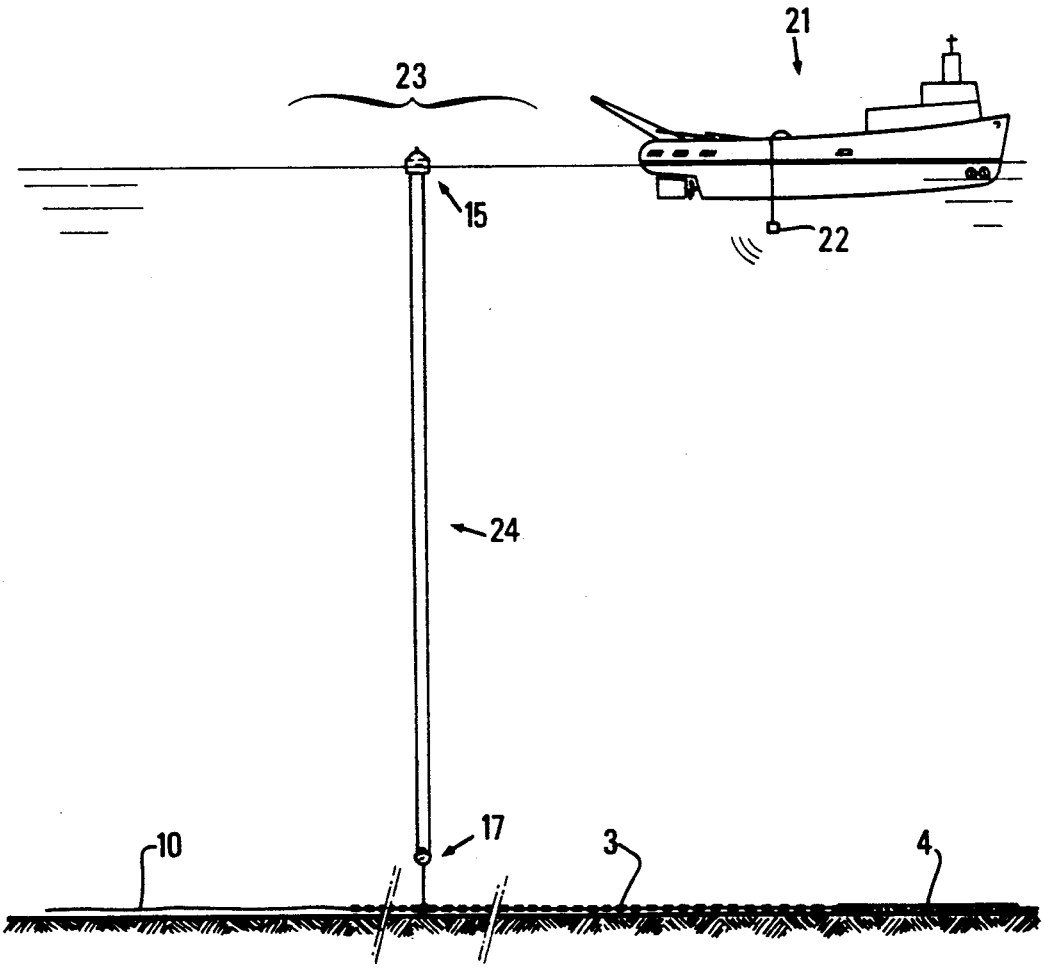
FIG. 9 is a schematic view of the fishing device of FIG. 8 at an end of a separation of the fishing device.

To recover the end of anchorage line 3, release of the releasable portion 15 of the fishing member is caused by means of an acoustic signal transmitter mounted on ship 21, so as to obtain the configuration illustrated in FIG. 9.

The fishing member of this figure corresponds to a second embodiment which is distinguished particularly from the first embodiment in that the connecting means 24 between the releasable portion 15 and support 17 comprises two strands coupled together at the level of the return means disposed in support 17, so as to form a loop through these return means. The two upper ends of these two strands are situated respectively on a reel, disposed in the releasable portion, serving as winder for the connecting means when the releasable portion 15 is separated from support 17.

To recover the end of achorage line 3, the releasable portion 15 is hauled on to ship 21, then the connecting means 24 are separated from the releasable portion 15 at the level of the latter.

The connecting means 24 initially existing between the releasable portion 15 and support 17 is in fact a temporary connection which is not adapted for fishing up a heavy body, such as an anchorage line of an oil platform. To overcome this drawback, the temporary connecting means 24 are replaced, for example, from ship 21, by connecting means adapted for lifting said anchorage line.

To carry out such replacement, at the end of one strand is fixed a cable which is more resistant than the one existing and the other strand is pulled so as to cause this resistant cable to pass through the return means so that this cable completely replaces the temporary connecting means. This operation may be carried out in one step or in several steps by successive substitution of stronger and stronger connecting means, in the case where the difference of strength between the connecting means adapted for lifting is very great.

Lifting of the anchorage line then takes place as described above.

Figure 10:
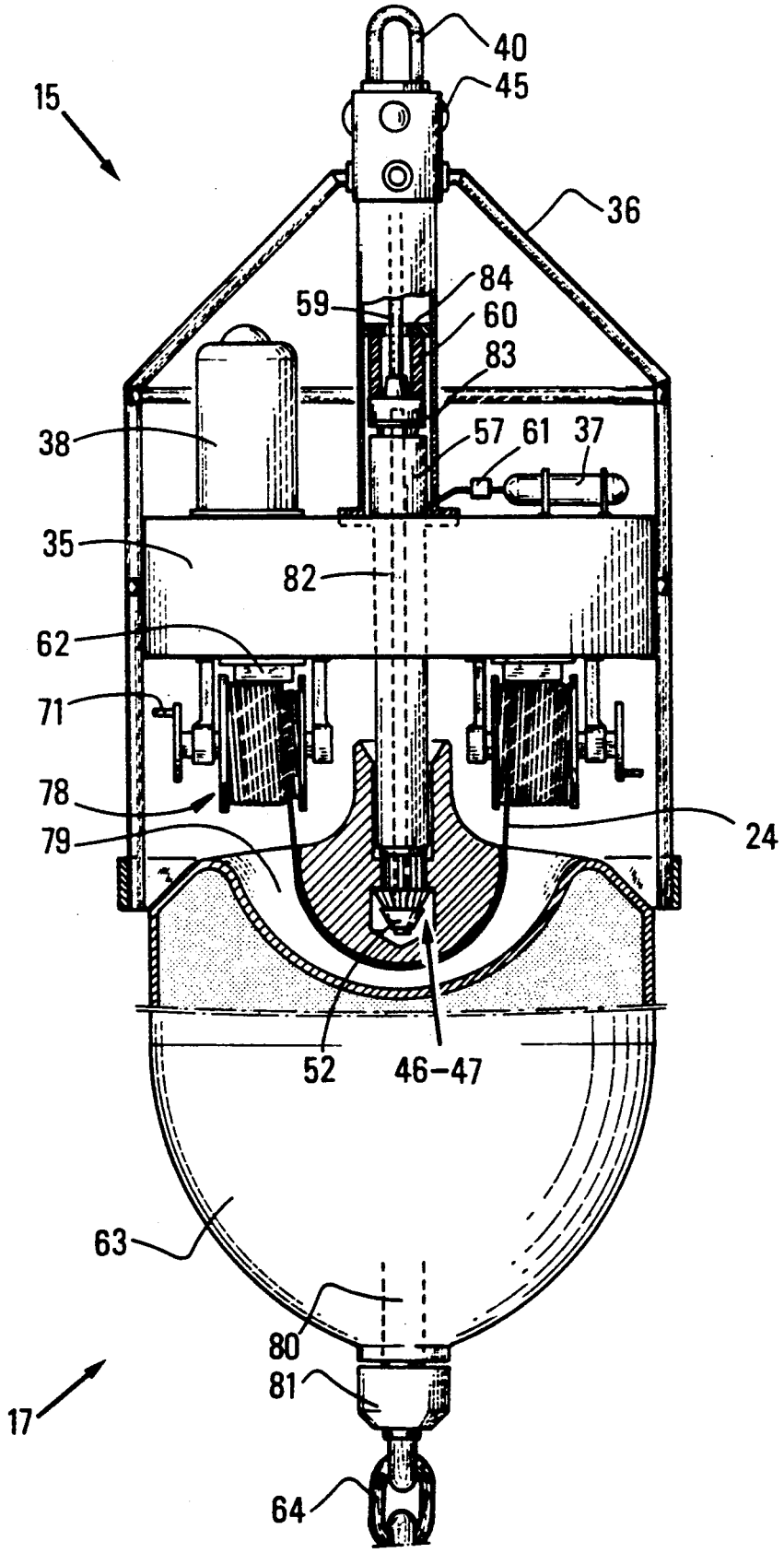
FIG. 10 is a schematic view of another embodiment of a lifting member constructed in accordance with the present invention.

FIG. 10 shows a second embodiment of a fishing member as a whole, support 17 being assembled to the releasable portion 15. The elements of this member and the elements of the fishing member illustrated in FIG. 6 are referenced in the same way.

In this second embodiment, the connecting means 24, which consist of a small cable, are wound on a reel and pass through the through hawse pipe 79. The two reels 78, playing the role of winder for the connecting means are braked in rotation by two plates 62 and are mounted on two shafts each of which comprises a plate and a stud 71 disposed towards the outside of the releasable portion, so as to be able to cooperate with a finger driving a rewinding tool.

Hawse pipe 79 is fixed to a shaft 80 itself fixed by a swivel 81 to a chain 64 connected to the anchorage line 3. About this shaft 80 is disposed float 63. In the center of the hawse pipe 79 is disposed a recess formed with a shoulder 47 adapted to cooperate with claws fast with the releasable portion 15 for assembling the latter with support 17. Retraction of the claws is caused by sliding of cone 52. Such sliding is caused either by a jack 57 whose rod is fixed to cone 52 by an extension 82, or by the safety ring 40 which is connected to the rod of jack 57, as previously shown in FIG. 6A.

Extension 82 has a shoulder 83 adapted for cooperating with resilient means 60 bearing on a stop 84. These resilient means are adapted so that release by means of ring 40 is triggered under the action of a force of given intensity.

For mooring the anchorage line 3 to vessel 1, the procedure is the same for the second embodiment of the fishing member as for the first previously described embodiment.

In the same way as maintenance of the releasable portion 15 is obtained in the first embodiment, by releasing this portion 15 when the anchorage line is fixed to the vessel, the same procedure may be used for this second embodiment of the releasable portion.

What is claimed is:

1. Method for fishing up an immersed body from a position spaced from and disposed above the immersed body, the method comprising the steps of:

providing a fishing means for enabling a fishing-up of the immersed body, said fishing means including a support connected to said immersed body and a releasable portion initially assembled to said support, mooring said fishing means to said immersed body, releasing the releasable portion so as to separate the releasable portion from the support and enable the releasable portion to reach the position spaced from and disposed above the immersed body, providing connecting means for connecting the immersed body to said releasable portion when said releasable portion is at said portion spaced from and disposed above the immersed body, and actuating the fishing means so as to place the immersed body in a vicinity of said fishing means.

2. The method as claimed in claim 1, wherein the connecting means are positioned between said immersed body and said releasable portion when said releasable portion has been released, and wherein the step of providing a connecting means includes connecting together first ends of first and second strands forming a temporary connecting means between the releasable portion and said support, and connecting the first and second strands with return means provided at the support.

3. The method as claimed in claims 1 or 2, wherein the immersed body is an anchorage line for a floating vessel located substantially above said immersed body, in a vicinity of said position, and wherein said anchorage line is moored to said floating vessel.

4. The method as claimed in claim 1, further comprising the steps of providing a retractable tool about the releasable portion for rewinding said connecting means in the releasable portion so as to reassemble said support and said releasable portion together, and retracting said tool after reassembling said support with said releasable portion.

5. The method as claimed in claim 1, wherein the immersed body is an anchorage line for a floating vessel located substantially above said immersed body and in a vicinity of said position, said anchorage line comprising a free end adapted to be moored to the vessel, said fishing means is disposed at a distance from said free end, said free end is adapted so that, when said anchorage line is moored to the vessel and said releasable portion assembled with said support, said fishing means is substantially unaffected by physical disturbances existing in a vicinity of the floating vessel, and wherein lifting connecting means are disposed between said fishing means and said anchorage at a point on the anchorage line between said free end and said fishing means and disposed in a vicinity of said end.

6. A method as claimed in claim 5, further comprising the step of providing means disposed on said lifting connecting means for spacing said lifting connecting means from said anchorage line.

7. A device for remotely fishing a body immersed in water from a position situated substantially vertically above said body, the device comprising a fishing means including a support secured to said body and a floating releasable portion; means for connecting the support to the releasable portion; means provided in said releasable portion for storing the connecting means; and means for unwinding the connecting means from the storage means when the releasable portion is separated from the support and rises to a surface of the water.

8. The device as claimed in claim 7, wherein said connecting means are temporary connecting means in the form of a loop including a first strand and a second strand connecting together at return means provided at the support, wherein the return means cooperate with the connecting means, and wherein the return means and the temporary connecting means are adapted for replacing the temporary connecting means by connecting means for lifting said body.

9. The device as claimed in claim 7, further comprising a retractable rewinding tool means for cooperable with said storage means for rewinding said connecting means and said storage means.

10. The device as claimed in one of claims 7, 8 or 9, further comprising means for remotely causing release of the support from said releasable portion.

11. The device as claimed in one of claims 7 or 8, wherein said body comprises an end of an anchorage line, and lifting connecting means disposed between the releasable portion and said end of the anchorage line.

* * * * *